US006912812B2

(12) United States Patent
Inage

(10) Patent No.: US 6,912,812 B2
(45) Date of Patent: Jul. 5, 2005

(54) SLIDING DOOR APPARATUS

(75) Inventor: Akio Inage, Mie (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/647,514

(22) Filed: Aug. 26, 2003

(65) Prior Publication Data

US 2004/0255517 A1 Dec. 23, 2004

(30) Foreign Application Priority Data

Jun. 18, 2003 (JP) ..... 2003-172808

(51) Int. Cl.[7] ..... E05D 13/00; E05D 15/06; E05C 7/04

(52) U.S. Cl. ..... 49/409; 49/366; 49/425; 49/370; 49/116; 16/91; 16/97; 16/87 R

(58) Field of Search ..... 49/409, 420, 366, 49/425, 410, 421, 411, 413, 370, 116, 118, 120; 16/87 R, 91, 97, 99, 105–107

(56) References Cited

U.S. PATENT DOCUMENTS 5,090,171 A * 2/1992 Kano et al. ..... 49/409
6,021,547 A * 2/2000 Stagoll ..... 16/105
6,141,827 A * 11/2000 Wu ..... 16/91
6,526,625 B2 * 3/2003 Becken ..... 16/105

* cited by examiner

*Primary Examiner*—Hugh B. Thompson, II
(74) *Attorney, Agent, or Firm*—Manabu Kanesaka

(57) ABSTRACT

A side sliding door apparatus for an electric railcar includes a side sliding door suspended from a horizontal door rail with a C-shape cross-section. The side sliding door is capable of moving freely via a door roller, and a gap is formed between the door roller and a ceiling of the door rail. A guide roller with a smaller diameter than that of the door roller is provided adjacent to the door roller. A gap between the guide roller and the ceiling of the door rail is set to be smaller than that between the door roller and the ceiling of the door rail. Preferably, a gap adjusting mechanism is provided for adjusting the gap between the guide roller and the ceiling of the door rail.

5 Claims, 4 Drawing Sheets

Fig. 3
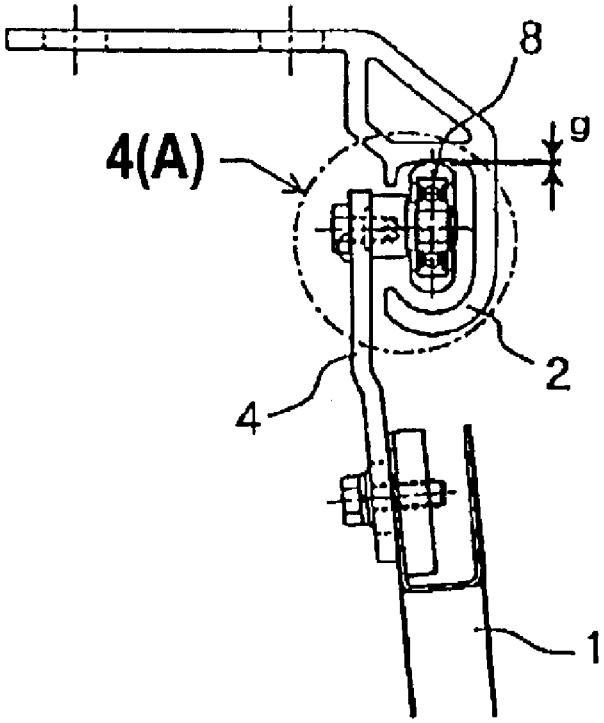
Fig. 4(A)
Fig. 4(B)
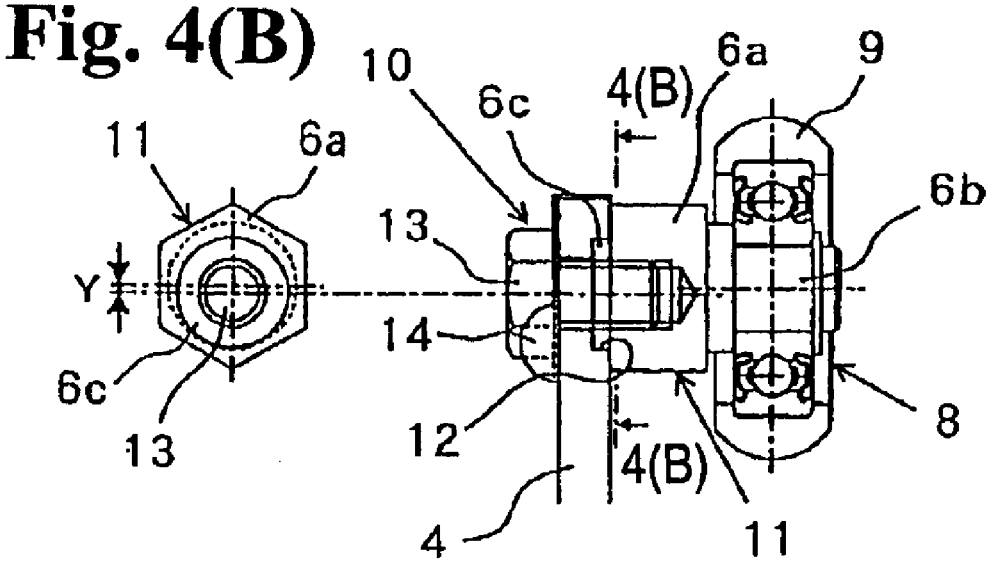

SLIDING DOOR APPARATUS

BACKGROUND OF THE INVENTION AND RELATED ART STATEMENT

The present invention relates to a sliding door apparatus in an electric railcar for opening and closing a sliding door at an entrance of the electric railcar. In particular, the present invention relates to a structure for supporting the sliding door through suspension.

Japanese Patent Publication (Kokai) No. 2000-142392 has disclosed a side sliding door apparatus for an electric railcar. As shown in FIGS. 5 and 6, such a conventional sliding door apparatus has a structure for supporting a side sliding door through suspension. FIG. 5 is a front view showing an essential part of the side sliding door, and FIG. 6 is a sectional view taken along line 6—6 in FIG. 5. The left-hand side in FIG. 6 corresponds to a vehicle compartment side. In FIGS. 5 and 6, a side sliding door 1 is suspended from a door rail 2 to move horizontally in FIG. 1 via door rollers 3. The door rollers 3 are mounted on each of door hangers 4 provided at right and left locations of the side sliding door 1, and the side sliding door 1 is fixed to the door hangers 4 via bolts 6.

The door rail 2 is made of aluminum, and has a C-shape cross-section with a curved bottom as shown in FIG. 6. The door rollers 3 are guided to move along the curved bottom of the door rail 2. An appropriate gap G is formed between a ceiling of the door rail 2 and the door rollers 3 so that the door rollers 3 can rotate without being obstructed by the ceiling of the door rail 2. The side sliding door apparatus is a double-hinged type, and two side sliding doors 1 are provided at the right and left sides of each entrance. FIG. 5 shows only the side sliding door 1 at the left side.

FIG. 5 shows a state that the side sliding door apparatus is closed. In response to a door open signal, an actuator drives the side sliding door 1 to move leftward in FIG. 5, and also drives a side sliding door at the right side (not shown) to move rightward to open the entrance. When a door close signal is sent in this state, the side sliding doors are closed as shown in FIG. 5.

The conventional side sliding door apparatus for the electric railcar shown in FIGS. 5 and 6 has problems as follows. First, when a passenger applies a lateral load (in a direction indicated by an arrow in FIG. 6) to the side sliding door 1, the door rollers 3 move upward along the curved bottom of the door rail 2. As a result, the gap G between the ceiling of the door rail 2 and the door rails 3 may become too small. If there is no gap, the door rollers 3 are stuck in the door rail 2, thereby making it difficult to open and close the entrance.

As described above, if the gap G is too small, the door rollers 3 are stuck, and it is difficult to open and close the entrance. On the other hand, if the gap G is too large, the side sliding doors 1 are greatly tilted in the directions indicated by arrows in FIG. 7 when a foreign material 7 such as a passenger's finger is caught between the side sliding doors 1 as shown in FIG. 7. In this case, the side sliding doors 1 contact with each other only at respective upper sides thereof. Accordingly, there may be a dangerous situation in which the side sliding doors 1 are locked in this state and the electric railcar is started as it is.

Note that when the side sliding doors 1 are closed, the side sliding doors 1 are locked by a locking mechanism (not shown). At the same time, a door closure detecting switch is operated to turn on a pilot lamp on a driver compartment.

When the side sliding doors 1 are locked even in the state the side sliding doors 1 are tilted, it is determined that the side sliding doors 1 are closed normally according to the pilot lamp. Therefore, the electric railcar may be started as it is.

The gap G is easily varies according to dimensional variations in the door rail 2 and the door rollers 3. Therefore, it is difficult to maintain the gap G at a proper size.

It is therefore an object of the present invention to provide a side sliding door apparatus for an electric railcar, which is effective with a lateral load applied by a passenger and a foreign material caught between side sliding doors.

Further objects and advantages of the invention will be apparent from the following description of the invention.

SUMMARY OF THE INVENTION

To attain the objects described above, a side sliding door apparatus for an electric railcar includes a side sliding door suspended from a horizontal door rail with a C-shape cross-section. The side sliding door is capable of moving freely via a door roller, and a gap is formed between the door roller and a ceiling of the door rail. A guide roller with a smaller diameter than that of the door roller is provided adjacent to the door roller. A gap between the guide roller and the ceiling of the door rail is set to be smaller than that between the door roller and the ceiling of the door rail.

In the present invention, the guide roller is provided for restricting an upward movement of the side sliding door in addition to the door roller suspended from the door rail for supporting a downward load applied to the side sliding door. The gap between the guide roller and the ceiling of the door rail is set to be smaller than that between the door rail and the door roller. In the present invention, when a passenger applies a lateral load to the side sliding door and the door roller move upward along a curved bottom of the door rail, the guide roller contacts the ceiling of the door rail before the door roller contacts the ceiling of the door rail. Therefore, it is possible to prevent the door roller from becoming stuck when the door roller contacts the bottom of the door rail and the ceiling of the door rail simultaneously.

Further, in the present invention, the guide roller restricts the upward movement of the side sliding door even when a foreign material is caught in the side sliding door in a state that there is a large gap between the door roller and the ceiling of the door rail. As a result, the side sliding door does not tilt. Therefore, it is possible to provide a large gap, and to prevent the door roller from becoming stuck due to a small gap even if there are dimensional variations in the door roller and the door rail.

According to the present invention, it is preferred to provide a gap adjusting mechanism for adjusting the gap between the guide roller and the ceiling of the door rail. With this configuration, it is easy to properly set the gap between the guide roller and the ceiling of the door rail.

According to the present invention, the gap adjusting mechanism may be comprised of an eccentric shaft and a screw for fastening the eccentric shaft at an arbitrary rotational position. The eccentric shaft has protruding shafts formed at both ends thereof to be eccentric with each other. One of the protruding shafts at one end of the eccentric shaft supports the guide roller, and the other of the protruding shafts at the other end of the eccentric shaft rotatably engages the side sliding door.

BRIEF DESCRIPTION OF THE DRAWINGS

FIG. 3 is an explanatory sectional view taken along line 3—3 in FIG. 1;

FIG. 4(A) is an enlarged view of a section 4(A) shown in FIG. 3, and FIG. 4(B) is a sectional view taken along line 4(B)—4(B) in FIG. 4(A);

DETAILED DESCRIPTION OF PREFERRED EMBODIMENTS

Figure 1:
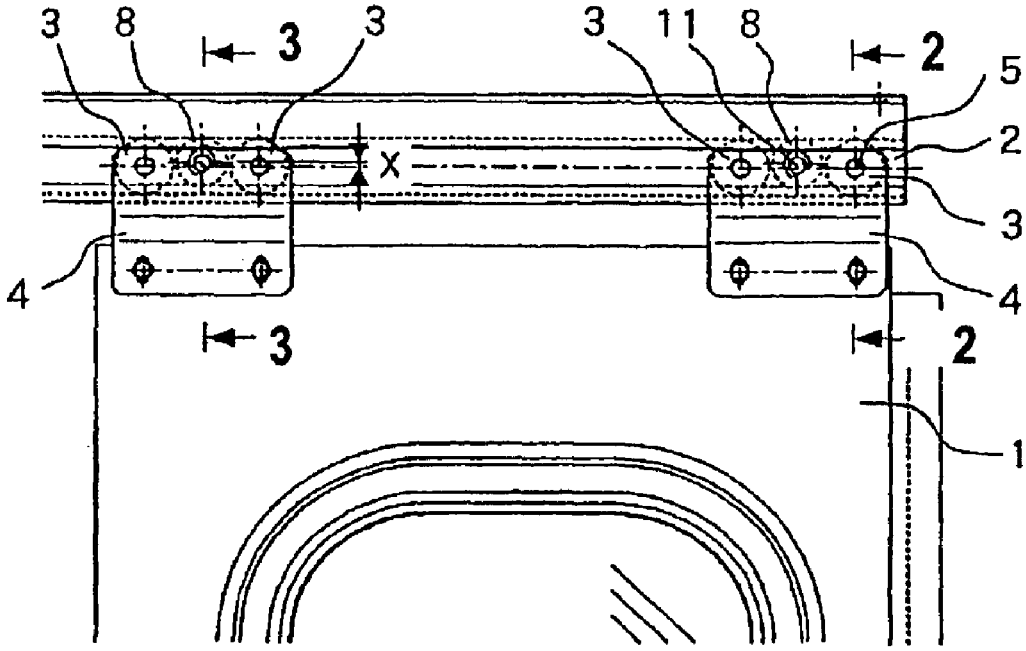
FIG. 1 is a front view showing an essential part of a side sliding door apparatus for an electric railcar according to an embodiment of the present invention.
Figure 2:
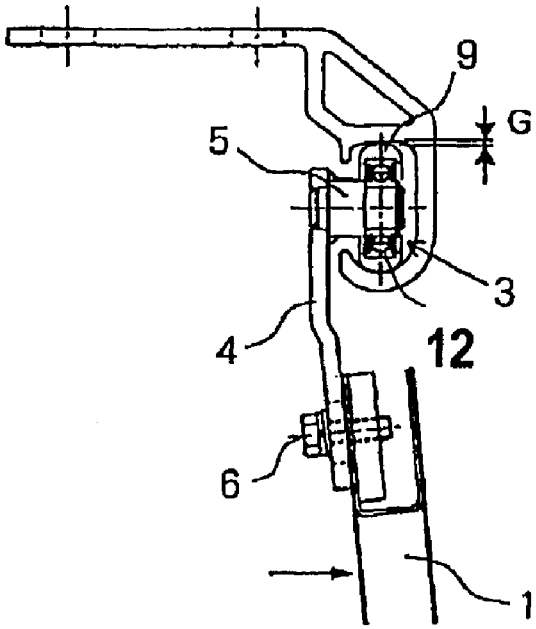
FIG. 2 is an explanatory sectional view taken along line 2—2 in FIG. 1.
Figure 5:
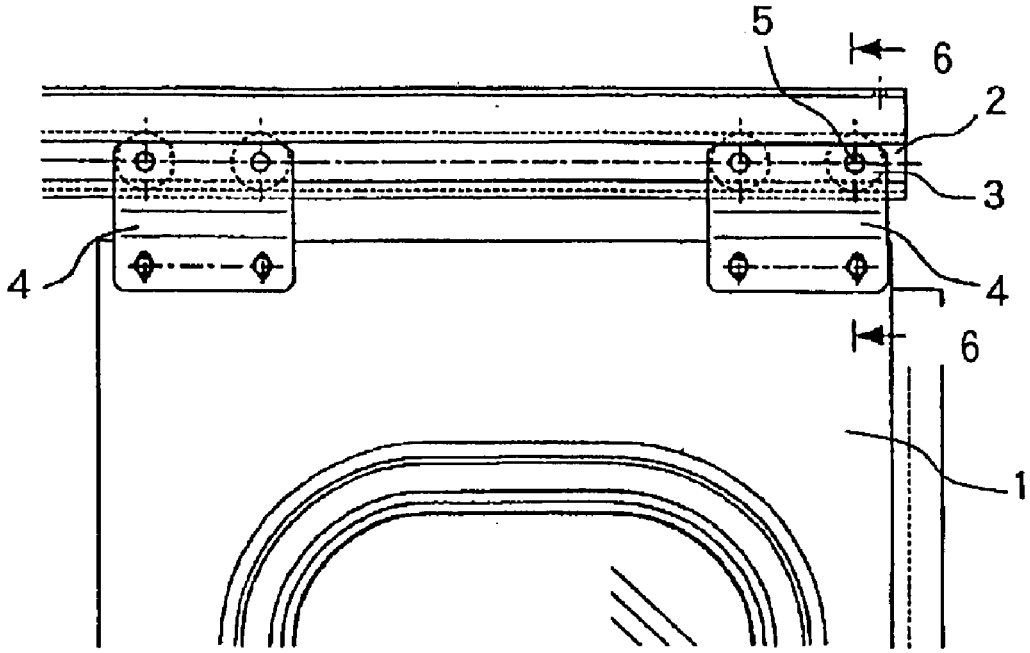
Fig. 5 Prior Art
FIG. 5 is a front view showing an essential part of a conventional side sliding door apparatus for an electric railcar.
Figure 6:
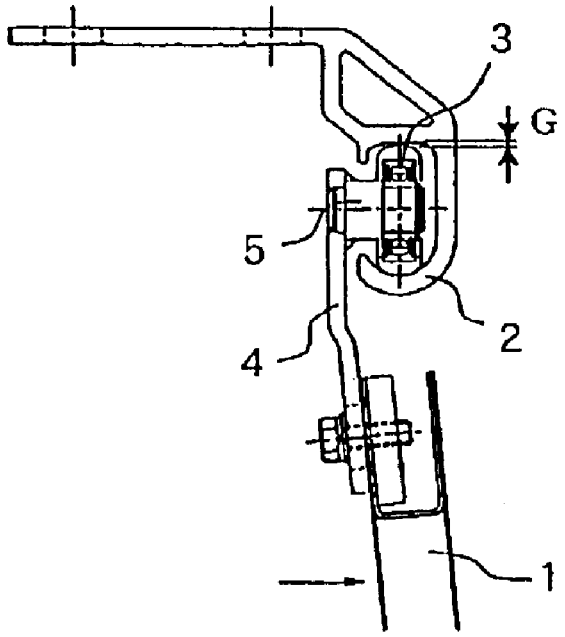
Fig. 6 Prior Art
FIG. 6 is a sectional view taken alone line 6—6 in FIG. 5.

Hereunder, embodiments of the present invention will be explained with reference to the accompanying drawings. FIG. 1 is a front view showing an essential part of a left side sliding door of a double-hinged side sliding door apparatus according to the present embodiment. FIG. 2 is a sectional view taken along line 2—2 in FIG. 1, and FIG. 3 is a sectional view taken along line 3—3 in FIG. 1. FIG. 4(A) is an enlarged view of a section 4(A) shown in FIG. 3, and FIG. 4(B) is a sectional view taken along line 4(B)—4(B) in FIG. 4(A). It should be noted that components corresponding to those in the conventional apparatus shown in FIG. 5 and FIG. 6 are denoted by the same reference numerals.

In FIGS. 1 to 4, the present embodiment differs from the conventional apparatus in that a guide roller 8 is provided adjacent to and between two door rollers 3 attached to each of door hangers 4. The guide roller 8 is disposed at a location higher than the door rollers 3 by a distance X.

Each of the door rollers 3 is constructed such that a tier 9 made of urethane rubber is adhered to an outer ring of a ball bearing 12. The guide roller 8 has the same structure as the door rollers 3, but has a size smaller than the door rollers 3. For example, in a case that an outer diameter D of the door roller 3 is 45 mm, an outer diameter d of the guide roller d is 40 mm (d is smaller than D). A gap g (refer to FIG. 3) between the guide roller 8 and a ceiling of the door rail 2 is smaller than a gap G (refer to FIG. 2) between the door roller 3 and the ceiling of the door rail 2 (g is smaller than G). For example, the gap g is set to be about 0.1 to 0.2 mm, which is equal to or less than 1/10 of the gap G. The gap g can be adjusted by a gap adjusting mechanism 10 shown in FIG. 4.

As shown in FIGS. 4(A) and 4(B), the guide roller 8 is attached to the side sliding door, i.e. the door hanger 4 via an eccentric shaft 11 constituting the gap adjusting mechanism 10. The eccentric shaft 11 is comprised of protruding shafts 6*b* and 6*c* provided at both ends of a hexagonal body 6*a*. The protruding shafts 6*b* and 6*c* are eccentric with each other by a dimension Y, and the guide roller 8 is supported on the protruding shaft 6*b* at one end of the hexagonal body 6*a*. The protruding shaft 6*c* at the other end of the hexagonal body 6*a* rotatably engages a cylindrical concave 12 formed in the door hanger 4.

The eccentric shaft 11 is tightly secured to the door hanger 4 via a bolt 13, which is screwed into a screw hole formed coaxially with the protruding shaft 6*c* to penetrate through the door hanger 4. In place of the bolt 13, a screw rod may be provided at an end of the protruding shaft 6*c* to protrude from the door hanger 4, so that a nut can engages the screw rod. Reference numeral 14 denotes a lock fitting that crosses over the door hanger 4 and the bolt 13. In FIGS. 4(A) and 4(B), the gap g (refer to FIG. 3) can be adjusted in a range of twice the dimension Y by loosening the bolt 13 and rotating the eccentric shaft 11 around the protruding shaft 6*c* once. After the adjustment, the bolt 13 is fastened again.

In FIGS. 1 to 3, the gap G is formed between the door roller 3 and the ceiling of the door rail 2, and the gap g smaller than the gap G is formed between the guide roller 8 and the ceiling of the door rail 2. The guide roller 8 is apart from the bottom of the door rail 2. In the side sliding door apparatus constructed as above, when a passenger applies a lateral load to the slide sliding door 1 in a direction indicated by an arrow in FIG. 2 and the door rollers 3 move upward along the curved surface of the bottom of the door rail 2, the guide roller 8 contacts the ceiling of the door rail 2 (as g is smaller than G) before the door rollers 3 contact the ceiling of the door rail 2, so that the upward movement of the side sliding door 1 is restricted.

Accordingly, the door rollers 3 do not contact the bottom of the door rail 2 and the ceiling of the door rail 2 at the same time. Therefore, the side sliding door 1 is smoothly opened and closed while being supported and guided by the door rollers 3 contacting the bottom of the door rail 2 and the guide roller 8 contacting the ceiling of the door rail 2.

Figure 7:
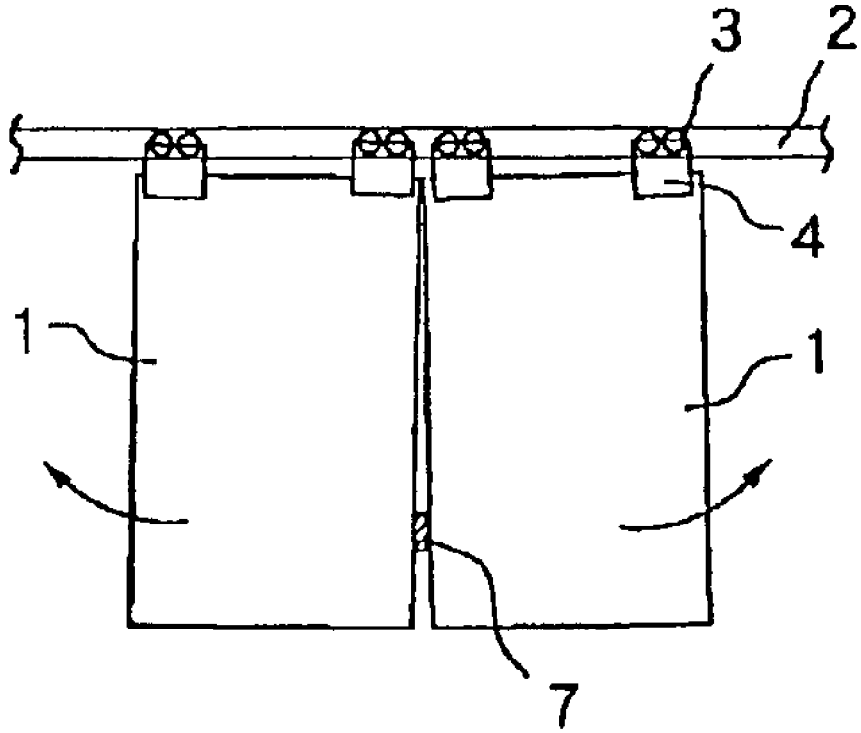
Fig. 7 Prior Art
FIG. 7 is a front view showing a state in which side sliding doors shown in FIG. 5 are tilted.

When the foreign material 7 (refer to FIG. 7) is caught between the side sliding doors 1, the side sliding doors 1 are not greatly tilted even if the gap G is large, because the guide roller 8 restricts the upward movement of the side sliding doors 1. Therefore, even if a foreign material is caught between the side sliding doors 1, there is no situation where only the upper portions of the side sliding doors 1 are closed in a tilted state and the electric railcar starts moving as it is.

It is possible to set the gap G to be large. Accordingly, the door rollers 3 can be prevented from becoming stuck due to the gap G becoming excessively small even if there are dimensional variations in the door rollers 3 and the door rail 2. Further, the adjusting mechanism 10 is provided for adjusting the gap g as shown in FIG. 4. Therefore, it is possible to open and close the side sliding doors 1 smoothly by adjusting the gap g to be a small size of 0.1 mm or less, for example.

In the embodiment, one guide roller is provided between the two door rollers. The number of the door rollers and guide roller may be arbitrarily determined. Further, in the illustrated embodiment, the side sliding door apparatus is the double-hinged type. The present invention may be applied to a single swinging side sliding door apparatus comprised of one side sliding door. Further, the mechanism for adjusting the gap between the guide roller and the door rail is not necessarily limited to the illustrated structure.

As described above, according to the present invention, the guide roller is provided for restricting the upward movement of the side sliding doors in addition to the door rollers suspended from the door rail for supporting the downward load applied to the side sliding doors. Therefore, it is possible to smoothly open and close the side sliding doors while preventing the door rollers from becoming stuck even if a lateral load is applied thereto by a passenger. Further, it is possible to prevent the side sliding doors from being tilted when a foreign material is caught therebetween, thereby preventing such a dangerous situation that the electric railcar is started in the state in which the foreign material is caught between the side sliding doors with the incomplete locked state.

While the invention has been explained with reference to the specific embodiments of the invention, the explanation is illustrative and the invention is limited only by the appended claims.

What is claimed is:

1. A sliding door apparatus for opening and closing an entrance, comprising:

a door rail horizontally attached above the entrance and having a C-shape cross-section with a ceiling, a sliding door suspended from the door rail for sliding freely therein, a door roller attached to the sliding door and disposed in the door rail with a first gap between the door roller and the ceiling of the door rail, and a guide roller attached to the sliding door adjacent to the door roller and having a diameter smaller than that of the door roller, said guide roller being disposed in the door rail, in a same orientation as the door roller, with a second gap between the guide roller and the ceiling of the door rail to be smaller than the first gap.

2. A sliding door apparatus according to claim 1, further comprising a gap adjusting mechanism attached to the sliding door for adjusting the second gap.

3. A sliding door apparatus according to claim 1, wherein said guide roller is situated between two door rollers, said guide roller and two door rollers being arranged vertically.

4. A sliding door apparatus for opening and closing an entrance, comprising:

a door rail horizontally attached above the entrance and having a C-shape cross-section with a ceiling, a sliding door suspended from the door rail for sliding freely therein, a door roller attached to the sliding door and disposed in the door rail with a first gap between the door roller and the ceiling of the door rail, a guide roller attached to the sliding door adjacent to the door roller and having a diameter smaller than that of the door roller, said guide roller being disposed in the door rail with a second gap between the guide roller and the ceiling of the door rail to be smaller than the first gap, and a gap adjusting mechanism attached to the sliding door for adjusting the second gap, wherein said gap adjusting mechanism includes an eccentric shaft having protruding shafts at two ends eccentric with each other, one of said protruding shafts holding the guide roller and the other of said protruding shafts rotatably engaging the sliding door, and a screw for fastening the eccentric shaft at an arbitrary position.

5. A sliding door apparatus according to claim 4, wherein said guide roller is situated between two door rollers.

* * * * *

UNITED STATES PATENT AND TRADEMARK OFFICE

CERTIFICATE OF CORRECTION

PATENT NO. : 6,912,812 B2
DATED : July 5, 2005
INVENTOR(S) : Akio Inage

It is certified that error appears in the above-identified patent and that said Letters Patent is hereby corrected as shown below:

Column 3,
Line 11, please change “alone” to -- along --.

Signed and Sealed this

Thirtieth Day of August, 2005

JON W. DUDAS
*Director of the United States Patent and Trademark Office*